US007657970B2

(12) United States Patent
Artsiely

(10) Patent No.: US 7,657,970 B2
(45) Date of Patent: Feb. 9, 2010

(54) DEVICE FOR PREVENTING DOOR SLAMMING

(75) Inventor: Eyal Artsiely, Moshav Fazael (IL)

(73) Assignee: Rav Bariach Security Products Ltd., Yavne (IL)

( * ) Notice: Subject to any disclaimer, the term of this patent is extended or adjusted under 35 U.S.C. 154(b) by 96 days.

(21) Appl. No.: 11/689,006

(22) Filed: Mar. 21, 2007

(65) Prior Publication Data

US 2007/0226954 A1 Oct. 4, 2007

(30) Foreign Application Priority Data

Mar. 30, 2006 (IL) ..... 174673

(51) Int. Cl.
*E05F 5/06* (2006.01)

(52) U.S. Cl. ..... 16/85; 16/82

(58) Field of Classification Search ..... 16/85, 16/63, 65, 72, 76, 82; 292/60, 252, 137, 292/1; 267/124, 70, 226, 289, 139
See application file for complete search history.

(56) References Cited

U.S. PATENT DOCUMENTS 4,462,623 A * 7/1984 Grant ..... 292/175
4,483,639 A * 11/1984 McCandless, II ..... 403/317
4,545,322 A * 10/1985 Yang ..... 188/67
4,601,502 A * 7/1986 Van Dyke ..... 292/252
4,760,621 A * 8/1988 Stromquist ..... 16/85
5,061,112 A * 10/1991 Monford, Jr. ..... 403/328
5,727,286 A * 3/1998 Shen ..... 16/49
5,746,458 A * 5/1998 Fisher ..... 292/252
6,615,450 B2 * 9/2003 Salice ..... 16/85
6,957,727 B2 * 10/2005 Leung ..... 188/371
7,032,271 B2 * 4/2006 Lin ..... 16/85
7,281,704 B2 * 10/2007 Salice ..... 267/124
2003/0141638 A1 * 7/2003 Salice ..... 267/34
2003/0213663 A1 * 11/2003 Salice ..... 188/284
2004/0150143 A1 * 8/2004 Zimmer et al. ..... 267/64.11
2005/0217072 A1 * 10/2005 Lin ..... 16/85

* cited by examiner

*Primary Examiner*—Victor Batson
*Assistant Examiner*—Emily M Morgan
(74) *Attorney, Agent, or Firm*—The Law Office of Michael E. Kondoudis

(57) ABSTRACT

A device for preventing door slamming including a housing that has a bore formed therein, a control element that slides in the bore, the control element having a bore formed therein, a plunger that slides in and out of the bore of the control element, the plunger being biased against a distal end of the bore of the control element by a biasing device, and a stopper element received in the plunger and extending into the control element, wherein a slamming force applied on the plunger dislodges the stopper element from the plunger so that the stopper element becomes lodged in the control element and the housing, thereby preventing the control element from sliding in the bore of the housing.

5 Claims, 4 Drawing Sheets

DEVICE FOR PREVENTING DOOR SLAMMING

FIELD OF THE INVENTION

The present invention relates generally to devices for preventing slamming of doors.

BACKGROUND OF THE INVENTION

Slamming doors is a well known problem with most hinged doors. Slamming can cause damage to the door or door jamb. A careless slam of the door can sometimes cause injury to an innocent person whose fingers are caught in the gap between the door and the door jamb. Slamming can also create unwanted noise that disturbs sleeping people.

Various devices for preventing door slamming are known, such as hydraulic dampers that use viscous damping to cushion the door slam or stoppers or bumpers that prevent the door from being closed.

SUMMARY OF THE INVENTION

The present invention seeks to provide an improved device for preventing slamming of doors, as is described in detail hereinbelow.

There is thus provided in accordance with an embodiment of the present invention a device for preventing door slamming including a housing that has a bore formed therein, a control element that slides in the bore, the control element having a bore formed therein, a plunger that slides in and out of the bore of the control element, the plunger being biased against a distal end of the bore of the control element by a biasing device, and a stopper element received in the plunger and extending into the control element, wherein a slamming force applied on the plunger dislodges the stopper element from the plunger so that the stopper element becomes lodged in the control element and the housing, thereby preventing the control element from sliding in the bore of the housing.

In accordance with an embodiment of the present invention a distal portion of the control element is arranged for sliding in the bore of the housing against a biasing device.

Further in accordance with an embodiment of the present invention the plunger has a distal shaft portion that extends into and slides in and out of the bore of the control element, the distal shaft portion being biased against the distal end of the bore of the control element by the biasing device.

Still further in accordance with an embodiment of the present invention the control element has a transverse bore formed therein, generally perpendicular to the bore of the control element, wherein the distal shaft portion is formed with an annular groove and the stopper element is received in the annular groove of the distal shaft portion and extends into the transverse bore of the control element.

In accordance with an embodiment of the present invention the housing includes an end cap with a transverse annular groove formed therein corresponding to the transverse bore of the control element, wherein a slamming force applied on the plunger causes compression of the biasing device and dislodges the stopper element from the annular groove so that the stopper element becomes lodged in the transverse bore of the control element and the transverse annular groove of the end cap, thereby preventing the control element from sliding in the bore of the housing.

Further in accordance with an embodiment of the present invention a spring force of the biasing device of the control element is greater than that of the biasing device of the housing.

Still further in accordance with an embodiment of the present invention if a non-slamming force is applied against the plunger, the stopper element remains in the annular groove of the distal shaft portion and locks the distal shaft portion with the control element, so as to cause the control element to slide in the bore.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
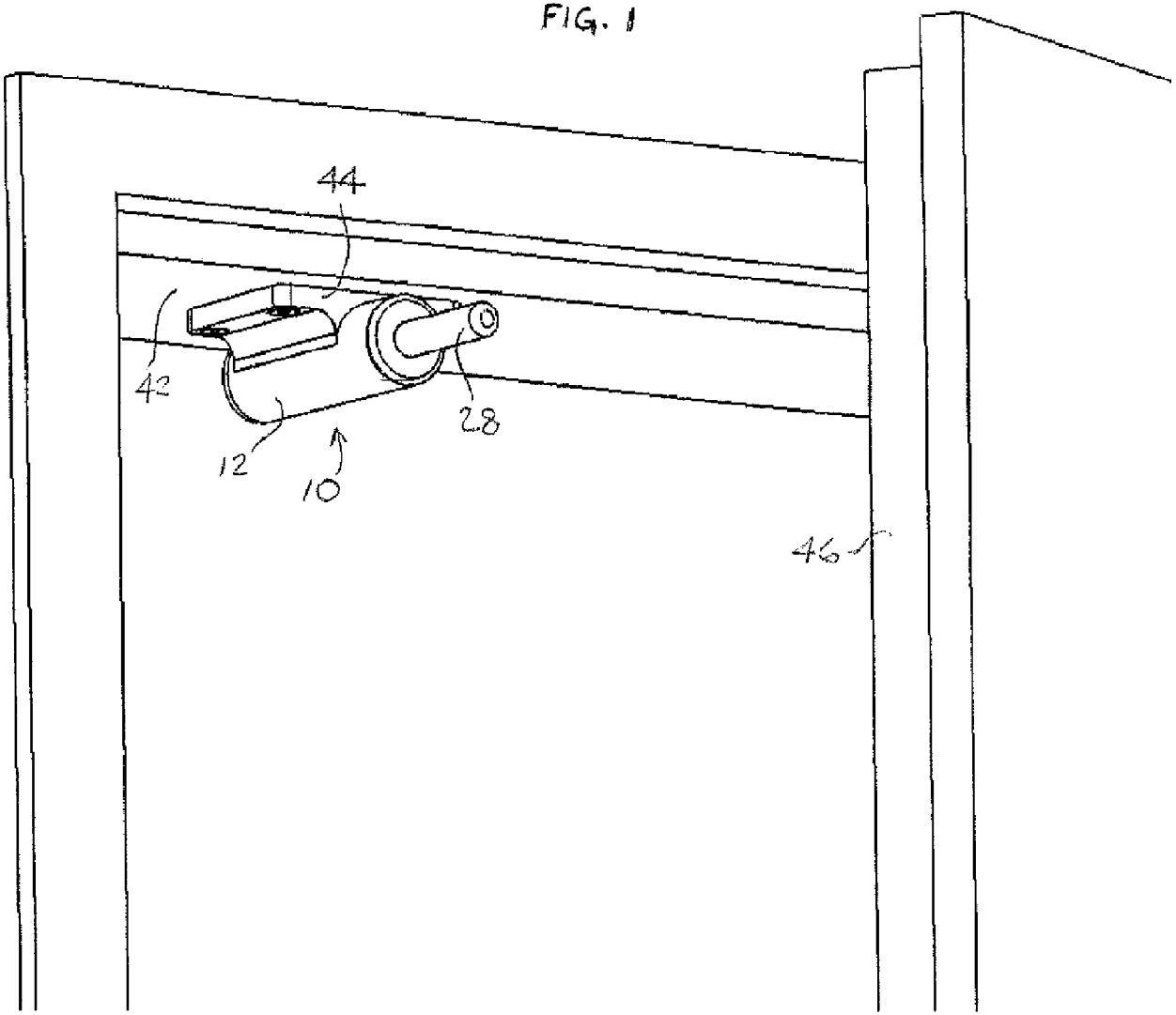
FIG. 1 is a simplified pictorial illustration of a device for preventing door slamming, constructed and operative in accordance with an embodiment of the present invention, installed in a door.
Figure 2:
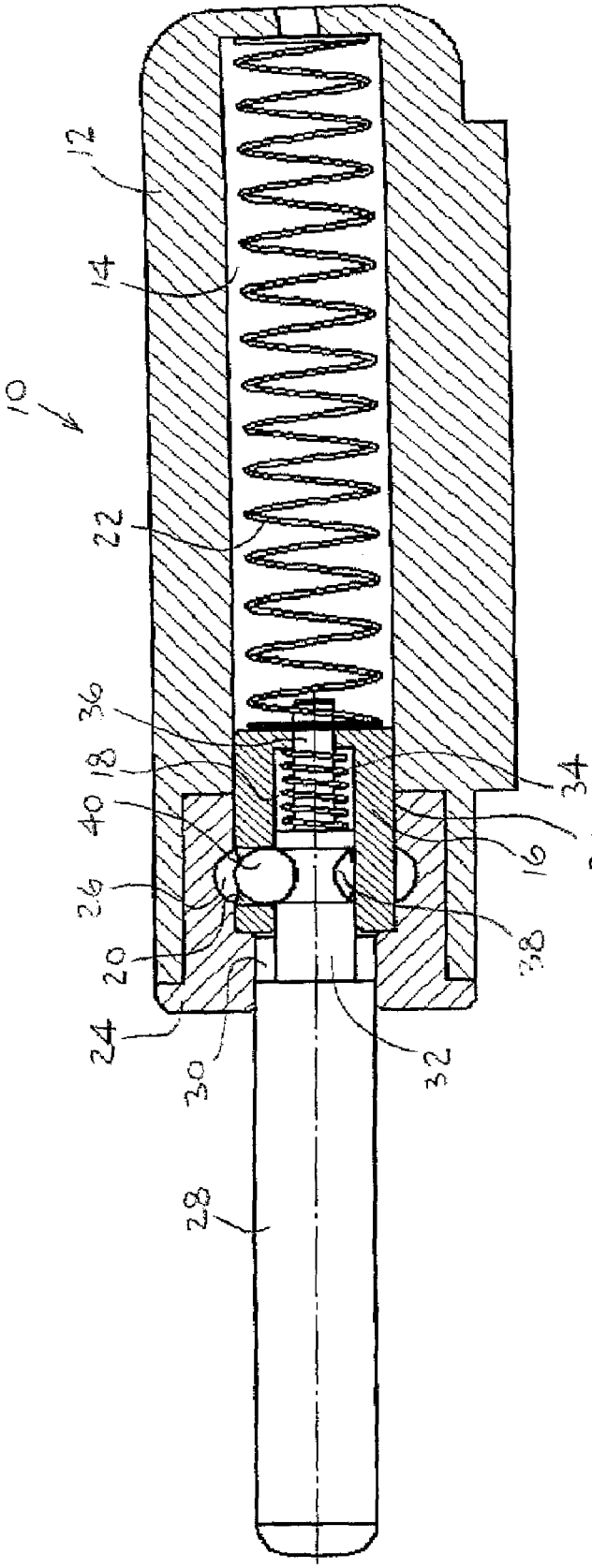
FIG. 2 is a simplified sectional illustration of the device of FIG. 1, before impact of a door thereagainst.

Reference is now made to FIGS. 1 and 2, which illustrate a device 10 for preventing door slamming, constructed and operative in accordance with an embodiment of the present invention.

As seen in FIG. 2, the device 10 may include a housing 12, which may be cylindrical in shape. Housing 12 may have a bore 14 (e.g., a central bore) formed therein in which may slide a control element 16, which may also be cylindrical in shape. The control element 16 may have a (central) bore 18 formed therein and a transverse bore 20, generally perpendicular to bore 18. The distal portion of control element 16 may slide in central bore 14 of housing 12 against a biasing device 22, such as a coil spring disposed in bore 14. The proximal portion of control element 16 is received in a bore 25 formed in an end cap 24 of housing 12. End cap 24 may be attached to the rest of housing 12, such as by welding, adhesive, mechanical fasteners or any other suitable means. End cap 24 may have a transverse annular groove 26 formed therein corresponding to the transverse bore 20 of control element 16.

A plunger 28, which may be cylindrical in shape, is arranged to slide in and out of a bore 30 formed in end cap 24. Plunger 28 may have a relatively narrower, distal shaft portion 32 that extends into and slides in and out of bore 18 of control element 16. The distal shaft portion 32 may be biased against the distal end of bore 18 by a biasing device 34, such as a coil spring, which may be placed about a narrower extension 36 of shaft portion 32, which may extend into bore 14 of housing 12. The distal shaft portion 32 may be formed with an annular groove 38. A stopper element 40, such as a ball, may be received in groove 38 and extend into transverse bore 20 of control element 16. The spring force of biasing device 34 may be greater than that of biasing device 22.

As seen in FIG. 1, the device 10 may be installed on the underside of the upper portion of a door frame 42. The device 10 may comprise a mounting bracket 44 for this purpose. The plunger 28 points towards a door 46.

Figure 3:
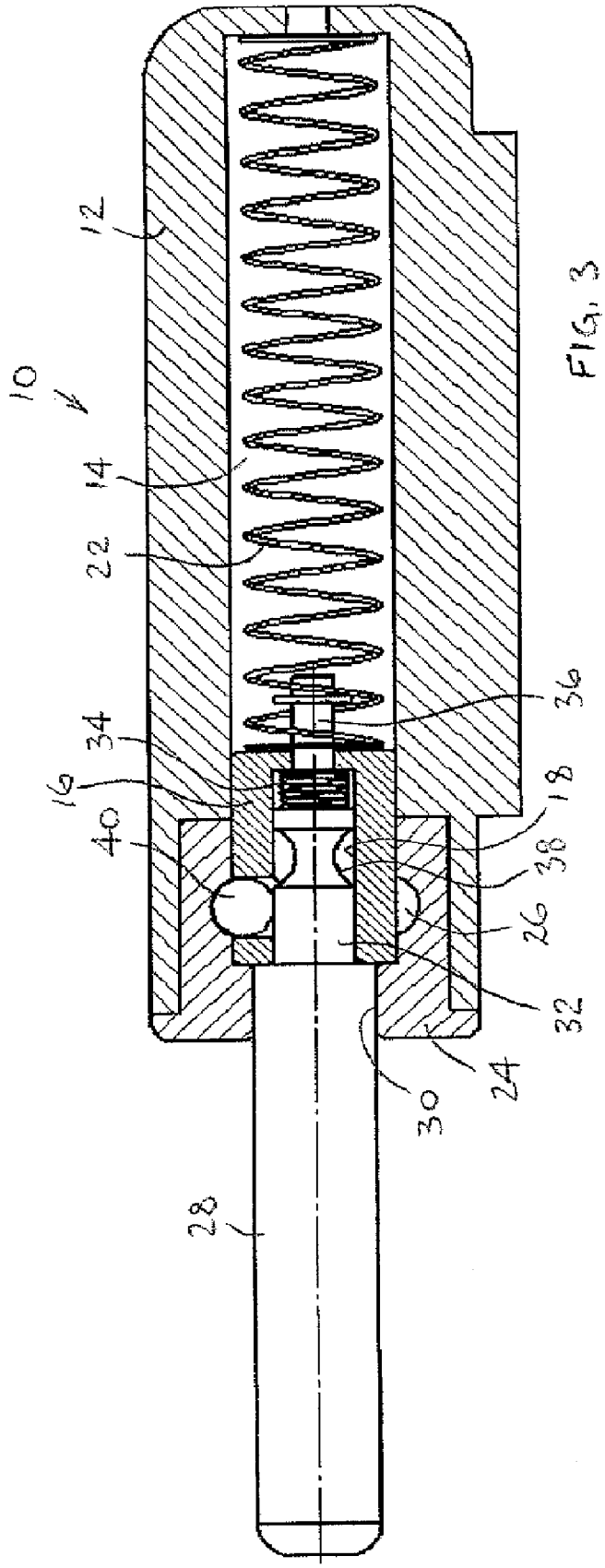
FIG. 3 is a simplified sectional illustration of the device of FIG. 1, upon impact of a slamming door thereagainst.

Reference is now made to FIG. 3. If door 46 (FIG. 1) is slammed against plunger 28, plunger 28 will slide in bore 30 and the distal shaft portion 32 of plunger 28 will slide in bore 18, thereby compressing biasing device 34. Stopper element 40 will dislodge from annular groove 38 and become lodged in transverse bore 20 of control element 16 and transverse annular groove 26 of end cap 24, thereby preventing control element 16 from sliding in bore 14. This may be due to the slamming force being absorbed by the biasing device 34, which compresses and allows stopper element 40 to dislodge from annular groove 38, without biasing device 22 coming into play. Thus, the axial motion of plunger 28 is arrested by stopper element 40 caught in transverse annular groove 26 and the door 46 (FIG. 1) will be stopped and cannot be slammed to a closed position, thereby preventing any injury to persons. Afterwards, the force of biasing device 34 pushes plunger 28 back out (to the left in the sense of FIG. 3) so that stopper element 40 resets in annular groove 38.

Figure 4:
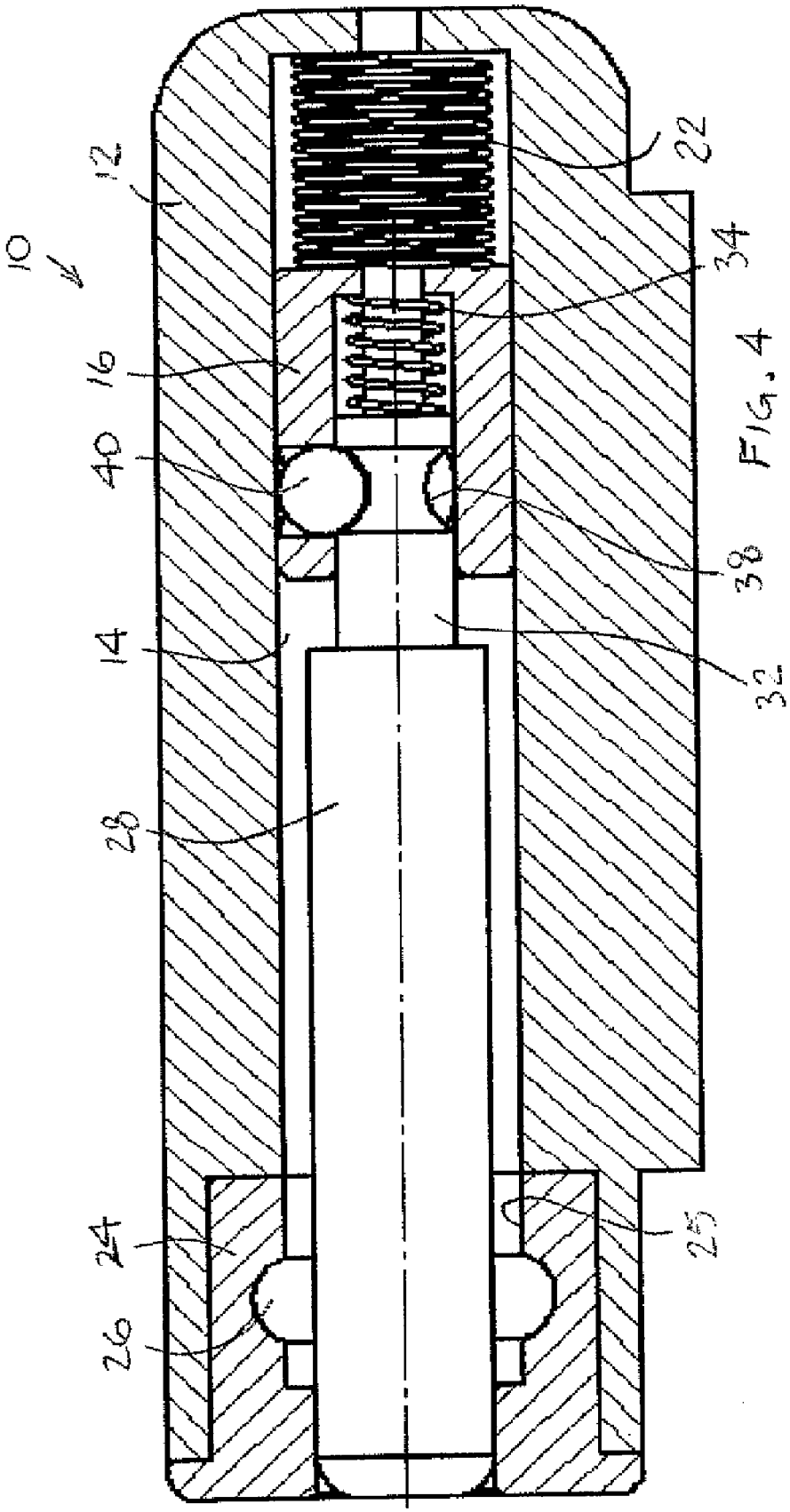
FIG. 4 is a simplified sectional illustration of the device of FIG. 1, upon impact of a normally closing door thereagainst.

Reference is now made to FIG. 4. If door 46 (FIG. 1) is not slammed but rather closed normally (e.g., gently) against plunger 28, stopper element 40 will remain in annular groove 38 and lock the distal shaft portion 32 with control element 16, with the result that the axial force applied against plunger 28 will cause the entire control element 16 to slide in bore 14, thereby compressing biasing device 22. Plunger 28 will thus slide through into bore 14 of housing 12 and the door 46 (FIG. 1) can close.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A device for preventing door slamming comprising:

a housing that has a bore formed therein, and is configured for attachment to a door frame;

a control element that slides in said bore, wherein a distal portion of said control element is arranged to slide in said bore of said housing against a first biasing device, and wherein said control element has a bore formed therein;

a plunger that slides in and out of said bore of said control element, said plunger being biased against a distal end of said bore of said control element by a second biasing device, and slides in response to a door force; and a stopper element received in said plunger and extending into said control element, said stopper element is responsive to an impact power applied on the plunger, wherein the second biasing device has a spring force greater than the spring force of the first biasing device, wherein if a door slamming force that exhibits an impact power above a predefined level is applied on said plunger, said stopper element is dislodged from said plunger so that said stopper element becomes lodged in said control element and said housing, thereby preventing said control element from sliding in said bore of said housing in order to prevent door slamming, and wherein if a door non-slamming force that exhibits an impact power below the predefined level is applied against said plunger, said stopper element remains in said plunger and locks said plunger with said control element, so as to cause said control element to slide in said bore in order to allow the door to close.

2. The device according to claim 1, wherein said plunger has a distal shaft portion that extends into and slides in and out of said bore of said control element, said distal shaft portion being biased against the distal end of said bore of said control element by said biasing device.

3. The device according to claim 2, wherein said control element has a transverse bore formed therein, generally perpendicular to said bore of said control element, wherein said distal shaft portion is formed with an annular groove and said stopper element is received in said annular groove of said distal shaft portion and extends into said transverse bore of said control element.

4. The device according to claim 3, wherein said housing comprises an end cap with a transverse annular groove formed therein corresponding to the transverse bore of said control element, wherein a slamming force applied on said plunger causes compression of said biasing device and dislodges said stopper element from said annular groove so that said stopper element becomes lodged in said transverse bore of said control element and said transverse annular groove of said end cap, thereby preventing said control element from sliding in said bore of said housing.

5. The device according to claim 4, wherein if a non-slamming force is applied against said plunger, said stopper element remains in said annular groove of said distal shaft portion and locks said distal shaft portion with said control element, so as to cause said control element to slide in said bore.

* * * * *